US006642891B2

(12) United States Patent
Baro

(10) Patent No.: US 6,642,891 B2
(45) **Date of Patent: *Nov. 4, 2003**

(54) ANTENNA WITH IMPROVED EFFICIENCY

(75) Inventor: José Marie Baro, Taverny (FR)

(73) Assignee: Alcatel, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 42 days.

(21) Appl. No.: 09/498,750

(22) Filed: Feb. 7, 2000

(65) Prior Publication Data

US 2001/0050642 A1 Dec. 13, 2001

(30) Foreign Application Priority Data

Feb. 22, 1999 (FR) ..... 99 02157

(51) Int. Cl.[7] ..... H01Q 1/24
(52) U.S. Cl. ..... 343/702; 343/790
(58) Field of Search ..... 343/702, 791–792; H01Q 1/24

(56) References Cited

U.S. PATENT DOCUMENTS 5,267,297 A * 11/1993 Kawano et al. ..... 343/702
5,563,615 A * 10/1996 Tay et al. ..... 343/792
5,617,105 A * 4/1997 Tsunekawa et al. ..... 343/702
5,703,602 A * 12/1997 Casebolt ..... 343/702
5,949,383 A * 9/1999 Hayes et al. ..... 343/790
5,995,050 A * 11/1999 Moller et al. ..... 343/702
5,995,065 A * 11/1999 Kitchener et al. ..... 343/791
6,081,236 A * 6/2000 Aoki ..... 343/702
6,137,998 A * 10/2000 Holshouser et al. ..... 343/702

FOREIGN PATENT DOCUMENTS

| | | |
|---|---|---|
| DE | 197 26 570 C1 | 12/1998 |
| EP | 0 675 562 A1 | 10/1995 |
| WO | WO 94/21053 | 9/1994 |

* cited by examiner

*Primary Examiner*—Michael C. Wimer
(74) *Attorney, Agent, or Firm*—Sughrue Mion, PLLC

(57) ABSTRACT

A transceiver, which may be a telephone for mobile networks, includes a metal or screened casing, an antenna support mounted on the casing at one end of the antenna support, and an antenna mounted on the other end of the antenna support. The antenna support has a physical or electrical length substantially equal to one quarter of the wavelength of waves emitted by the antenna. The transceiver has improved link efficiency.

30 Claims, 2 Drawing Sheets

ANTENNA WITH IMPROVED EFFICIENCY

The present invention relates to antennas and more precisely to antennas for transceivers of the portable telephone type.

BACKGROUND OF THE INVENTION

Portable telephones, designed to be used as terminals of mobile networks or to communicate with a fixed terminal, include an antenna which is fixed to the casing of the telephone and which is used to transmit radio messages to or from the portable telephone. In conventional use, the portable telephone is near the mouth and the ear. The user's head intercepts some of the radiation that could be beneficial to the quality of the radio link; also, electrical currents flow in the casing of the telephone and in the antenna and the proximity of the casing to the head means that these currents are absorbed or induce radiation in their environment which is wasted for the radio link. Earlier proposed solutions usually relate to the antenna and not to the currents which flow in the casing, even though they can represent the greater part of the energy wasted.

From the point of view of the function of the portable telephone, which is to provide efficient radio transmission, the portion of the electromagnetic energy absorbed by the user is wasted. The radiation lost for transmission is dissipated in the form of heat.

EP-A-0 588 365 describes a portable telephone in which the antenna radiation pattern is essentially on the side remote from the user's head. That document proposes placing the antenna in a position on the casing which is as far as possible from the user's head, and choosing the orientation of the antenna so as to limit radiation into the user's head. The casing can then serve as an electromagnetic screen. It is also proposed to mount the antenna on a telescopic arm which does not radiate and which is hinged to the casing. The arm can contain a coaxial cable or can itself form a coaxial cable.

DE-A-195 02 652 proposes to dispose the antenna of a portable telephone at one end of a telescopic support which does not radiate. It also proposes to dispose the antenna at one end of a support which does not radiate and which is pivoted to the upper end of the side of the casing. When not in use, the support is parallel to and extends along the side of the casing, and the antenna is near the lower end of the side of the casing. When in use, the support is pivoted by the user so that it is substantially in alignment with the casing.

WO-A-94 21053 proposes to dispose the antenna at the bottom end of a portable telephone. To this end, in one embodiment, it proposes to use a telescopic antenna which is directed downwards and whose end projects beyond the casing near the microphone, which is in the lower part of the casing. In a different embodiment, the invention proposes a fixing for adapting the same solution to existing casings which have an antenna in the upper part of the casing. To this end, it proposes to use an antenna extension which is connected to the base of the antenna at the upper end of the casing and extends along the side or the back of the casing. The extension is screened and contains a telescopic folding antenna which extends downwards when in use.

JP-A-7022832 proposes a reverse F type antenna in the form of a quarter-wave microstrip antenna which has a resonant frequency slightly different from that of the main antenna to enable the system to operate over a wider band and to limit gain reduction.

The above prior art solutions address only the electromagnetic radiation from the antenna and the distance between the radiating part of the antenna and the user's head. They do not address the currents which flow when in use in the casing and which degrade the link. The inventors have found that in the proposed solutions the efficiency of the antenna is increased because attenuation by the user's head is reduced. This leads to a corresponding increase in the currents or voltages in the casing. Radiation towards the user's head is therefore increased, in particular if the user's hand does not sufficiently attenuate the currents in the casing. This further reduces the efficiency of the link.

OBJECTS AND SUMMARY OF THE INVENTION

The invention proposes a solution to this new problem of indirect radiation towards the user's head via the casing. It addresses not only the radiation induced directly by the radiating part of the antenna but also that induced indirectly by the currents in the casing. In this way it improves the efficiency of the link.

To be more precise, the invention proposes a transceiver including a casing, an antenna support mounted on the casing at one end and an antenna mounted on the other end of the antenna support, which has a length substantially equal to one quarter of the wavelength of waves emitted by the antenna.

In one embodiment of the invention said length is the physical length of the support.

In another embodiment of the invention the support is provided with reactances and the electrical length of the support corresponds to one quarter of the wavelength of waves emitted by the antenna.

The support is advantageously provided with lumped reactances and said electrical length of the support corresponds to one quarter of the wavelength of waves emitted by the antenna in at least two frequency bands.

The casing is preferably a metal or screened casing.

In an embodiment of the invention the antenna support is parallel to one side of the casing.

In another embodiment of the invention the casing includes a loudspeaker and the support is disposed along the side of the casing opposite the loudspeaker.

The support is preferably in the form of a coaxial cable.

The transceiver advantageously further includes an outer casing enclosing the casing and the antenna support.

Finally, the transceiver preferably constitutes a telephone for mobile networks.

BRIEF DESCRIPTION OF THE DRAWINGS

Other features and advantages of the invention will become apparent on reading the following description of embodiments of the invention which is given by way of example and with reference to the accompanying drawings, in which.

MORE DETAILED DESCRIPTION

In the remainder of the description, the invention is described in a preferred application to portable telephones for mobile networks. It applies more generally to other types of transceivers.

To limit the currents transmitted by the casing, the invention proposes that the antenna be disposed on a support mounted on the casing and whose length is close to one quarter-wavelength. The quarter-wave support acts as a quarter-wave trap and limits the currents in the casing.

Figure 1:
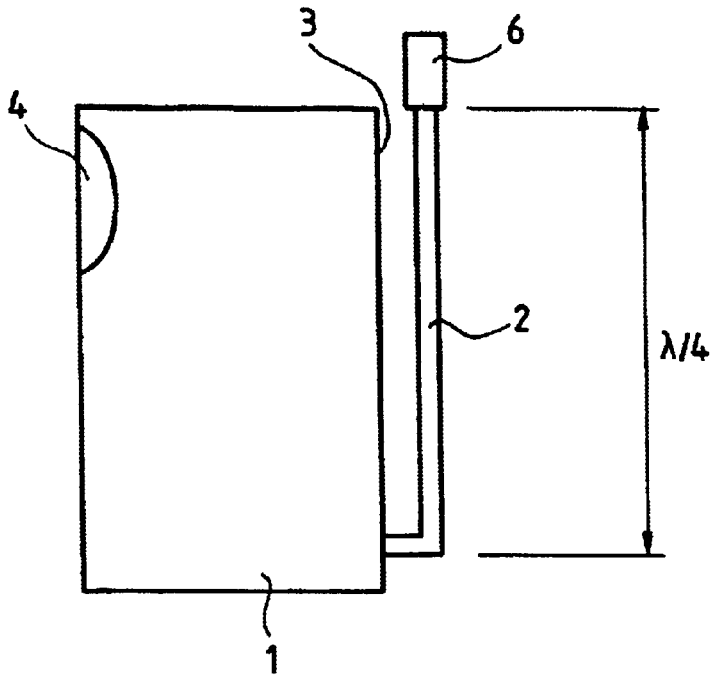
FIG. 1 is a diagrammatic representation of a transceiver of the invention.

FIG. 1 is a diagrammatic representation of a transceiver according to the invention in the example of a public mobile network transceiver (portable telephone). In the example shown in FIG. 1, the telephone has a casing 1 containing the telephone circuits, a loudspeaker and a microphone, a keypad, a display, and a device for receiving a subscriber identification module, for example a SIM or micro-SIM type integrated circuit card. In other words, the casing includes the standard functional units of a portable telephone with the exception of the antenna. The casing is advantageously made of metal or is screened to limit electromagnetic radiation by the circuits contained in the casing.

An antenna support 2 is mounted on the casing. In the embodiment shown in the figure the antenna support is fixed to the side 3 of the casing opposite the loudspeaker 4. The support extends along the casing and has a length substantially corresponding to one quarter of the wavelength used for radio transmission. In the case of a system to the GSM standard, the frequencies are in the order of 900 MHz, which corresponds to a wavelength of 30 cm, and the support has a length of approximately 7.5 cm. In the case of a system to the DCS standard, the frequencies are typically in the order of 1800 MHz, which corresponds to a wavelength of 15 cm, and the support has a length of approximately 3.75 cm.

Operation in both systems, i.e. coverage of two frequency bands, can easily be achieved by adding lumped or semi-lumped reactances, for example; these produce the quarter-wave support effect electrically for both frequency bands. Thus adding lumped reactances enables use of the invention in more than one frequency band.

In this way, the length of the support can physically correspond to one quarter-wavelength. It is also possible for the electrical length of the support to correspond to one quarter-wavelength, because of the presence of the reactances. In either case, the quarter-wave trap function is assured.

The support can be a section of coaxial cable, for example, and the outer jacket of the cable is advantageously electrically connected to the metal casing.

An antenna 6 is mounted at the end of the quarter-wave support 2. The antenna is connected to the casing by the coaxial cable which forms the antenna support.

The antenna support could instead be a rigid enclosure containing a cable, for example a coaxial cable, connecting the antenna to the circuits inside the casing.

The transceiver shown in FIG. 1 operates in the following manner. In use, the telephone is held with the loudspeaker near the ear. In this position, the antenna is as far as possible from the user's head and this limits direct electromagnetic radiation from the radiating part 6 of the antenna towards the user's head. This is because the radiation is limited by the distance and also by the small solid angle relative to the antenna represented by the user's head.

Also, because of the quarter-wave support, the antenna induces virtually no current in the casing. In fact, having a length of one quarter-wavelength, the support functions as a quarter-wave trap. This reduces indirect radiation into the user's head by the antenna via the casing. The invention therefore limits the proportion of electromagnetic radiation due to the casing and which would otherwise be lost in the user's head.

If the user's hand covers both the antenna support and the casing, as is generally the case, it modifies the impedance of the quarter-wave trap. Depending on how the hand is positioned, it damps the effect of the current trap to a greater or lesser degree, but the currents which are no longer absorbed by the trap are absorbed in any event, by the hand, and do not produce any radiation towards the head. This absorption of the currents by the hand leads to a partial loss of efficiency, but this contribution of the hand is no greater than in the case of conventional antennas that do not use the invention, and in particular quarter-wave antennas.

Figure 2:
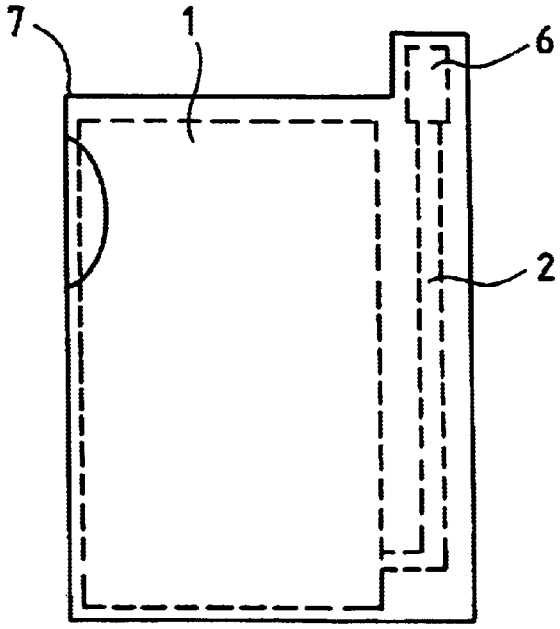
FIG. 2 is a diagrammatic representation of a transceiver according to the invention with an external casing.

FIG. 2 is a diagrammatic representation of a transceiver according to the invention with an insulative outer casing 7. In the embodiment shown in FIG. 2, the telephone is identical to that shown in FIG. 1 except that it has an insulative outer casing which encloses the metal casing shown in FIG. 1, the quarter-wave support and antenna, where applicable. The outer casing is typically a plastics material casing which assures the mechanical integrity of the internal casing, the quarter-wave support and the antenna.

FIGS. 3 to 6 are diagrammatic views of various embodiments of the invention in section on a median plane of the transceiver perpendicular to the plane of the support.

Figure 3:
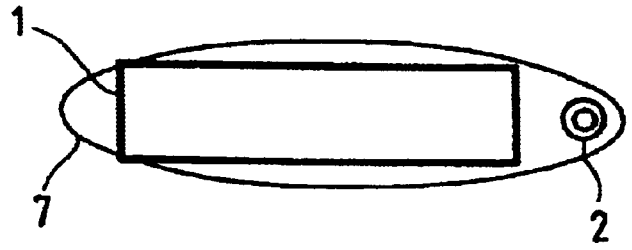
FIGS. 3 to 6 are diagrammatic representations in cross-section of various embodiments of the invention.

FIG. 3 shows a coaxial antenna support. Note the inner casing 1, the antenna support 2, and the outer casing 7. As shown in the figure, the inner casing has a rectangular cross-section and the antenna support is adjacent to one of the shorter sides of the rectangle. The outer casing encloses the inner casing and the antenna support.

Figure 4:
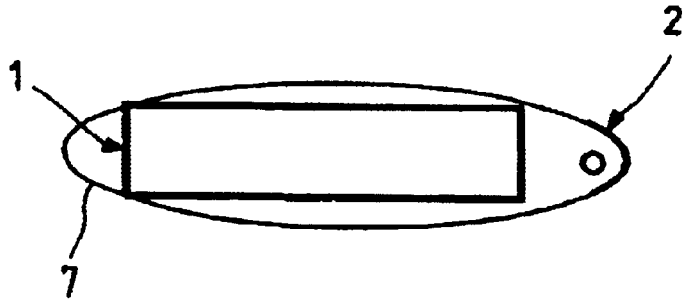
Figure 5:
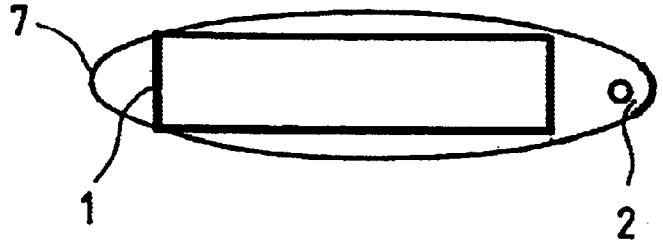
Figure 6:
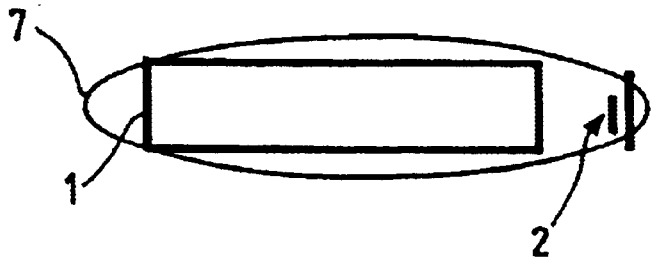

FIGS. 4 to 6 show variants of a stripline antenna support formed of two conductors. In all cases, the inner casing has a rectangular section, as in FIG. 3, and the antenna support is adjacent one shorter side of the rectangle.

FIG. 4 shows an embodiment in which one of the two stripline conductors espouses the local contour of the outer casing and partly surrounds the second conductor.

FIG. 5 shows an embodiment in which the outer conductor has a quarter-circle shape section disposed against the outer casing.

FIG. 6 shows an embodiment in which the stripline quarter-wave support is formed of two plane conductors.

Of course, the present invention is not limited to the examples and embodiments shown and described and lends itself to many variants that will be evident to the skilled person. The quarter-wave support in the embodiments of the invention described is parallel to the casing of the telephone and on the side thereof at the greatest possible distance from the user's head. The support could instead be on the rear of the casing. In the examples shown in the figures, the antenna is at the upper end of the telephone. It could instead be at the lower end of the telephone.

What is claimed is:

1. A transceiver, comprising:

a casing;

an antenna support having a first end and a second end, the antenna support mounted on the casing at the first end; and an antenna mounted on the second end of the antenna support;

wherein the antenna support defines a length between the casing and the antenna, the length being substantially equal to one quarter of the wavelength of waves emitted by the antenna, wherein said antenna support is substantially non-radiating, and further wherein said antenna support is mounted on an external surface of said casing, and said antenna is external to said casing.

2. The transceiver of claim 1, further comprising an outer casing that encloses the casing, the antenna and the antenna support.

3. The transceiver of claim 2, said antenna support comprising a plurality of stripline conductors.

4. The transceiver of claim 3, wherein a first conductor of the plurality of stripline conductors has a shape that conforms to an adjacent local contour of the outer casing, and partly surrounds a second conductor of the plurality of stripline conductors.

5. The transceiver of claim 4, wherein the first conductor has a quarter-circle shape section disposed against the outer casing.

6. The transceiver of claim 3, wherein the plurality of stripline conductors are formed of respective plane conductors.

7. A transceiver, comprising:

a casing comprising an inner casing and an outer casing, which encloses the inner casing and an antenna support;

the antenna support having a first end and a second end, the antenna support mounted on the inner casing at the first end;

an antenna mounted on the second end of the antenna support;

wherein the antenna support defines a length between the inner casing and the antenna, the length being substantially equal to one quarter of the wavelength of waves emitted by the antenna, and wherein the antenna support is formed of two stripline conductors.

8. The transceiver according to claim 7, wherein a first conductor of the two stripline conductors has a shape that conforms to an adjacent local contour of the outer casing, and partly surrounds a second conductor of the two stripline conductors.

9. The transceiver according to claim 8, wherein the two stripline conductors are formed of two plane conductors.

10. A transceiver, comprising:

a casing, comprising an inner casing and an outer casing that encloses the inner casing and an antenna support;

the antenna support, having a first end and a second end, the antenna support being mounted on the inner casing at the first end, the antenna support being formed of two stripline conductors; and an antenna mounted on the second end of the antenna support;

wherein the antenna support defines a length between the inner casing and the antenna, the length being substantially equal to one quarter of the wavelength of waves emitted by the antenna;

and wherein a first conductor of the two stripline conductors has a shape that conforms to an adjacent local contour of the outer casing, and partly surrounds a second conductor of the two stripline conductors;

and wherein the first has a quarter-circle shape section disposed against the conductor outer casing.

11. A transceiver, comprising:

a casing;

a current-trapping antenna support for limiting currents in the casing, the current-trapping antenna support having an entire length between a first end and a second end of the current trapping antenna support, the current-trapping antenna support mounted on the casing at the first end, a quarter-wavelength choke being defined by the entire length of the current-trapping antenna support; and an antenna mounted on the second end of the current-trapping antenna support, and further wherein said antenna support is mounted on an external surface of said casing, and said antenna is external to said casing.

12. The transceiver according to claim 11, wherein said entire length is the physical length of the current-trapping antenna support.

13. The transceiver according to claim 11, wherein the current-trapping antenna support is provided with reactance and wherein the electrical length of the current-trapping antenna support corresponds to on quarter of the wavelength of waves emitted by the antenna.

14. The transceiver according claim 11, wherein the current-trapping antenna support is provided with lumped reactances and wherein the electrical length of the current-trapping antenna support corresponds to on quarter of the wavelength of waves emitted by the antenna in at least two frequency bands.

15. The transceiver according to claim 11, wherein the casing is a metal or screened casing.

16. The transceiver according to claim 11, wherein the current-trapping antenna support is parallel to one side of the casing.

17. The transceiver according to claim 16, wherein the casing includes a loudspeaker and wherein the current-trapping antenna support is disposed along the side of the casing opposite the loudspeaker.

18. The transceiver according to claim 11, wherein the current-trapping antenna support is in the form of a coaxial cable.

19. The transceiver according to claim 11, further including an outer casing enclosing the casing and the current-trapping antenna support.

20. The transceiver according to claim 11, constituting a telephone for mobile networks.

21. The transceiver according to claim 11, wherein the entire length of the current-trapping antenna support is substantially equal to one quarter of the wavelength of waves emitted by the antenna.

22. The transceiver according to claim 21, wherein the current-trapping antenna support is formed of two stripline conductors.

23. The transceiver according to claim 22, wherein a first conductor of the two stripline conductors has a shape that conforms to an adjacent local contour of the casing, and partly surrounds a second conductor of the two stripline conductors.

24. The transceiver according to claim 23, wherein the first conductor has a quarter-circle shape section disposed against the casing.

25. The transceiver according to claim 23, wherein the two stripline conductors are formed of two plane conductors.

26. The transceiver of claim 11, wherein said casing is made of plastic.

27. The transceiver of claim 11, wherein said entire length is 3.75 cm for a DCS system and 7.5 cm for a GSM system.

28. The transceiver of claim 11, further comprising a device for receiving a subscriber identification module (SIM) that is a SIM or micro-SIM type integrated circuit card.

29. The transceiver of claim 11, wherein said antenna is mounted at a lower end of said transceiver.

30. The transceiver of claim 11, wherein said current-trapping antenna support is positioned on a rear surface of said casing.

* * * * *